United States Patent [19]

Tsuchida et al.

[11] Patent Number: 4,510,902

[45] Date of Patent: Apr. 16, 1985

[54] FUEL SUPPLY CONTROL IN DECELERATION OF AN INTERNAL COMBUSTION ENGINE FOR VEHICLES

[75] Inventors: Tsuyoshi Tsuchida; Yoshinobu Kido, both of Hiroshima, Japan

[73] Assignee: Mazda Motor Corporation, Hiroshima, Japan

[21] Appl. No.: 481,908

[22] Filed: Apr. 4, 1983

[30] Foreign Application Priority Data

Apr. 6, 1982 [JP] Japan ..... 57-57771

[51] Int. Cl.[3] ..... F02D 5/02

[52] U.S. Cl. ..... 123/325; 123/493

[58] Field of Search ..... 123/493, 325

[56] References Cited

U.S. PATENT DOCUMENTS 3,727,591 4/1973 Suda ..... 123/493
3,809,028 5/1974 Luchaco ..... 123/493
3,916,170 10/1975 Norimatsu et al. ..... 123/493 X
4,062,328 12/1977 Konno ..... 123/493
4,305,365 12/1981 Iizuka et al. ..... 123/493

FOREIGN PATENT DOCUMENTS 3446 10/1971 Japan .

*Primary Examiner*—Tony M. Argenbright
*Attorney, Agent, or Firm*—Fleit, Jacobson, Cohn & Price

[57] ABSTRACT

A vehicle including an internal combustion engine having a fuel supply system for providing a supply of fuel, a deceleration detecting device for detecting that the engine is in deceleration, a heater having heat exchanger for bringing air in the vehicle into a heat exchange relationship with engine cooling medium so that the air in the vehicle is heated by the engine cooling medium, a heater operation detecting device for detecting that the heater is in operation, a fuel supply control device responsive to outputs of the deceleration detecting device and the heater operation detecting device for interrupting the supply of fuel when the engine is in deceleration and the heater is not in operation.

5 Claims, 6 Drawing Figures

FUEL SUPPLY CONTROL IN DECELERATION OF AN INTERNAL COMBUSTION ENGINE FOR VEHICLES

The present invention relates to an internal combustion engine for motor vehicles and more particularly to a fuel supply system for such internal combustion engines.

In internal combustion engines for motor vehicles, it has already been proposed to interrupt fuel supply in deceleration so that fuel economy is improved and pollutant emissions are decreased. In this type of fuel supply systems, it has been recognized that there is a delay in the fuel supply to the combustion chamber in a succeeding acceleration in that, during the deceleration period wherein the fuel supply is interrupted, the fuel which has existed on the intake passage wall in the form of a film flow is vaporized and drawn into the engine combustion chamber, so that a part of the fuel supplied in the succeeding acceleration period will be deposited on the intake passage wall to form a film flow. If the fuel supply is interrupted in this type of engines even when the engine temperature is low, the fuel supply in the succeeding acceleration is further delayed because of poor atomization and vaporization of fuel under a low temperature so that there will be a high possibility of hesitation in acceleration and sometimes of engine stop.

In order to overcome the problems, the Japanese patent publication 50-3446 published on Feb. 5, 1975 proposes to continue the fuel supply even in a deceleration period when the engine temperature is below a predetermined value. The proposed fuel supply system is effective to eliminate the aforementioned problems in the conventional engines, however, it is not completely satisfactory when it is applied to an engine for a vehicle having heating facility. In general, vehicle heating systems have heat exchangers in which air is heated by engine cooling liquid. However, in the engine fuel supply system of the type described above, the temperature of the engine cooling liquid will be decreased when the deceleration is continued for a prolonged time resulting in an insufficient heating capacity.

It is therefore an object of the present invention to provide an engine fuel supply system in which supply of fuel is interrupted during engine deceleration without affecting the capacity of the vehicle heating system.

Another object of the present invention is to provide an engine fuel supply system which can provide an improved fuel economy without giving adverse effects on the smooth and stable engine operation and the heating capacity.

According to the present invention, the above and other objects can be accomplished by a motor vehicle including an internal combustion engine having a fuel supply system for providing a supply of fuel, deceleration detecting means for detecting that the engine is in deceleration, heating means having heat exchanging means for bringing air in the vehicle into a heat exchange relationship with engine cooling medium so that said air in the vehicle is heated by the engine cooling medium, heater operation detecting means for detecting that the heating means is in operation, fuel supply control means responsive to outputs of said deceleration detecting means and said heater operation detecting means for interrupting the supply of fuel when the engine is in deceleration and the heating means is not in operation. In a preferable mode of the present invention, the engine is further provided with engine temperature detecting means for producing an engine temperature signal which is applied to the fuel supply control means so that the supply of fuel is interrupted when the engine is in deceleration and the heating means is not in operation under an engine temperature above a predetermined value.

According to another aspect of the present invention, the motor vehicle includes an internal combustion engine having a fuel supply system for providing a supply of fuel, engine temperature detecting means, deceleration detecting means for detecting that the engine is in deceleration, heating means having heat exchanging means for bringing air in the vehicle into a heat exchange relationship with engine cooling medium so that said air in the vehicle is heated by the engine cooling medium, heater operation detecting means for detecting that the heating means is in operation, fuel supply control means responsive to outputs of said engine temperature detecting means, said deceleration detecting means and said heater operation detecting means for interrupting the supply of fuel when the engine is in deceleration and the heating means is in operation under an engine temperature above a first predetermined value and when the engine is in deceleration and the heating means is not in operation under an engine temperature above a second predetermined value which is lower than the first predetermined value.

The above and other objects and features of the present invention will become apparent from the following descriptions of preferred embodiments taking reference to the accompanying drawings, in which.

Figure 1:
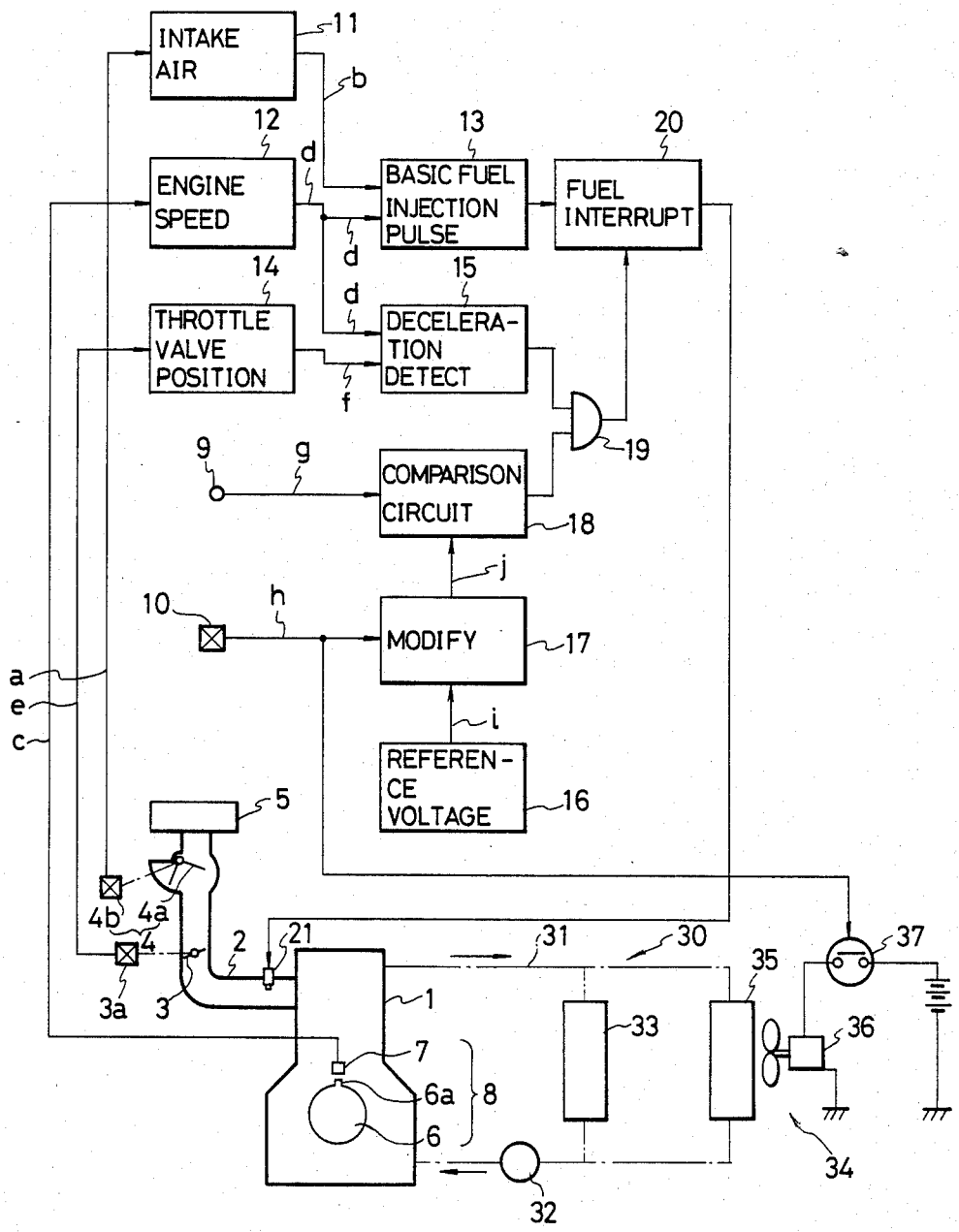
FIG. 1 is a diagrammatical illustration of an internal combustion engine having a fuel supply control system in accordance with one embodiment of the present invention.

Referring now to the drawings, particularly to FIG. 1, there is shown an internal combustion engine 1 having an intake passage 2 provided with a throttle valve 3. Upstream of the throttle valve 3, there is provided an airflow sensor 4 comprised of a damper valve **4*a* and a potentiometer 4*b*. Further, the intake passage 2 is provided at the upstream end with an air cleaner 5. The engine 1 also has a cooling liquid circulating system 30 including a cooling liquid passage 31 provided with a liquid pump 32 for circulating the cooling liquid though the water jacket (not shown) in the engine 1 and the liquid passage 31. In the liquid passage 31, there is provided a radiator 33 for cooling the engine cooling liquid. There is further provided a vehicle heating system 34 comprised of a heater core 35 disposed in the cooling liquid passage 31 in parallel with the radiator 33 and a blower 36 for sending vehicle room air through the heater core 35 so that the room air is heated by the engine cooling liquid passing through the cooling liquid passage 31. The blower 36 is controlled by a heater switch 10 which functions to close a relay switch 37**.

In the intake passage 2, there is a fuel injection nozzle 21 and an electric circuit is provided for controlling the operation of the fuel injection nozzle. For the purpose, the potentiometer 4*b* of the airflow sensor 4 produces an airflow signal a which is applied to an airflow voltage signal generating circuit 11. The circuit 11 produces a voltage signal b which has a value corresponding to the intake airflow. The engine 1 is provided with an engine speed sensor 7 comprised of a wheel 6 which is secured to one end of the engine crankshaft (not shown) and having a projection 6*a*, and a pick-up 7 which senses the projection 6*a* on the wheel 6 and produces a pulse signal c each time when the projection 6*a* passes a side of the pick-up. The pulse signal c from the pick-up 7 is applied to an engine speed signal generating circuit 12 which produces a voltage signal d in accordance with the engine speed. The throttle valve 3 is associated with a potentiometer or throttle valve position sensor 3*a*. The output e of the sensor 3*a* is applied to a throttle valve position signal generating circuit 14 which generates a voltage signal f in accordance with the position of the throttle valve 3.

Figure 2:
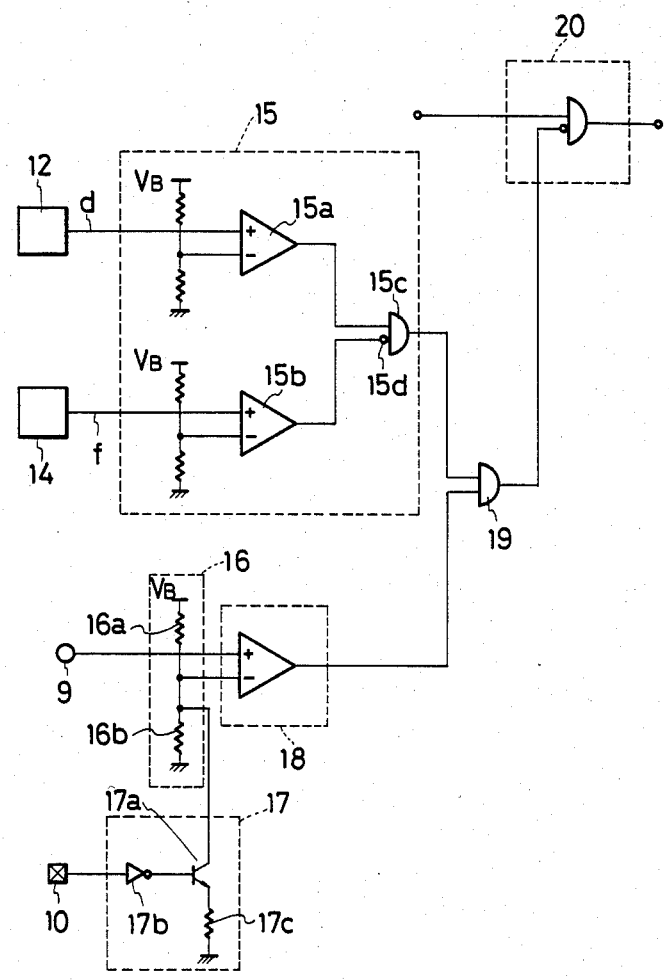
FIG. 2 is a diagram showing details of the circuits in the fuel supply control system shown in FIG. 1.

The airflow signal b from the circuit 11 and the engine speed signal d from the circuit 12 are applied to a basic fuel injection pulse generating circuit 13 which functions to determine the amount of fuel to be supplied to the engine 1 in accordance with the intake airflow signal b and the engine speed signal d so that an air-fuel mixture of desirable mixing ratio is formed. The output of the circuit 13 is applied through a fuel supply interrupting circuit 20 to the fuel injection nozzle 21 to operate the same. The engine speed signal d and the throttle valve position signal f are applied to a deceleration detecting circuit 15 which produces a deceleration signal when the throttle valve 3 is closed and the engine speed is greater than the engine idling speed. As shown in FIG. 2, the circuit 15 comprises a pair of comparators 15*a* and 15*b* and an AND gate 15*c*. The comparator 15*a* receives the engine speed signal d from the circuit 12 to compare the signal d with a reference voltage and produces a high level output when the speed signal d is greater than the reference voltage. The output of the comparator 15*a* is applied to the AND circuit 15*c*. The comparator 15*b* is applied with the throttle valve position signal f from the circuit 14 to compare the signal f with a reference voltage and produces a high level output when the position signal f is greater than the reference voltage. The output of the comparator 15*b* is applied to the AND gate through an inverter 15*d*. Thus, the AND gate 15*c* produces a high level output when the engine speed is greater than a predetermined value and the throttle valve opening is smaller than a further predetermined value to indicate that the engine is in deceleration. The output of the circuit 15 is applied to an AND circuit 19 which also receives a signal from a comparator 18. The comparator 18 receives an engine temperature signal g from an engine temperature sensor 9 which detects the temperature of the engine cooling liquid. There is further provided a reference circuit 16 for producing a reference voltage i which is applied to a modifying circuit 17. The circuit 17 receives a heater operation signal h from the heater switch 10 and modifies the reference voltage i when the heater 34 is in operation to produce a modified signal j which is higher than the reference voltage i. When the heater 34 is not in operation, the modifying circuit 17 passes the reference voltage i without modification. Speaking in more detail, as shown in FIG. 2, the reference circuit 16 is in the form of a voltage divider including a pair of series-connected resistors 16*a* and 16*b*, and the modifying circuit 17 is connected in parallel with the resistor 16*b*. The circuit 17 includes a transistor 17*a* having a base connected through an inverter 17*b* with the heater switch 10. The transistor 17*a* is grounded through a resistor 17*c* so that when the heater switch 10 is OFF, the transistor 17*a* is turned on and a low level voltage is applied to the comparator 18. When the heater switch 10 is turned on, the transistor 17*a* is turned off so that a high level voltage is applied to the comparator 18. The comparator 18 functions to compare the engine temperature signal g with the signal from the modifying circuit 17 and produces a high level output when the engine temperature signal is greater than the signal from the circuit 17. The AND circuit 19 produces a high level output when high level signals are received from the circuits 15 and 18 to operate the fuel supply interrupting circuit 20 so that the fuel supply from the nozzle 21 is interrupted.

It will therefore be understood that, in decelerating operation of the engine 1 and when the vehicle heater 34 is in operation, the fuel supply is cut only when the engine temperature is higher than a first predetermined value at which the engine temperature signal exceeds the modified reference signal j. However, when the vehicle heater 34 is not in operation, the reference signal i is passed to the comparator 18 without being modified so that the fuel supply is cut when the engine temperature is greater than a second predetermined value which is lower than the first predetermined value. Thus, when the vehicle heater is to be operated, the engine temperature is maintained above a relatively high value so that a satisfactory heating capacity is ensured.

Figure 3:
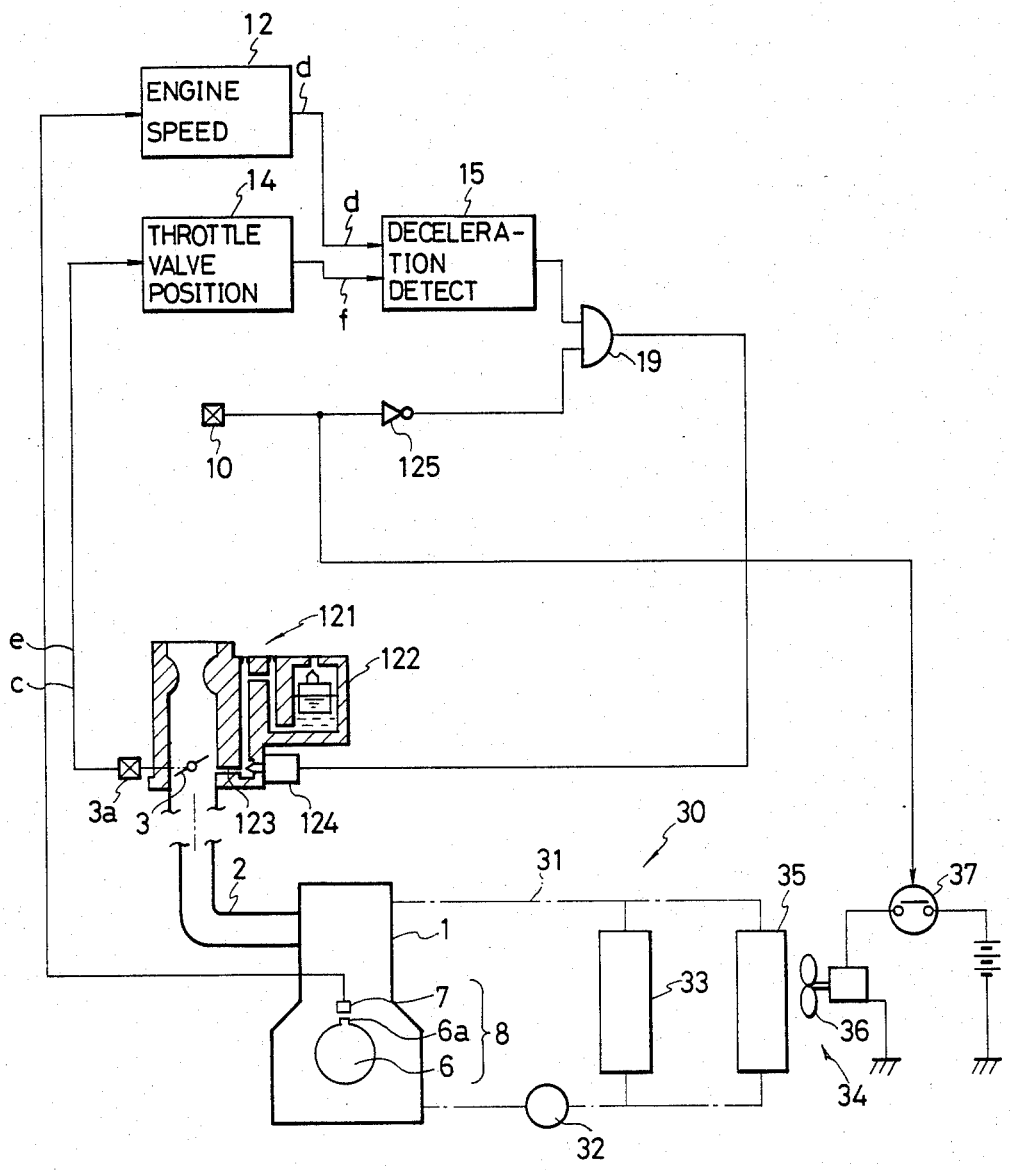
FIG. 3 is a diagrammatical illustration of an engine in accordance with another embodiment of the present invention.

Referring to FIG. 3, there is shown another embodiment of the present invention in which the engine 1 has a carburetor 121 having a float chamber 122 and an idle port 123. The idle port 123 is associated with a normally open solenoid valve 124 which is adapted to be energized by the output from an AND circuit 19. The AND circuit 19 has inputs, one being connected with the output of a deceleration detecting circuit 15 which is identical to the circuit 15 in the previous embodiment. The other input of the AND circuit 19 is connected through an inverter 125 with the heater switch 10. In other respects, the arrangements are the same as in the previous embodiment, so that detailed descriptions are omitted simply giving the same reference numerals to corresponding parts. In this embodiment, the idle port 123 is closed by the solenoid valve 124 in deceleration only when the heater is not in operation.

Figure 4:
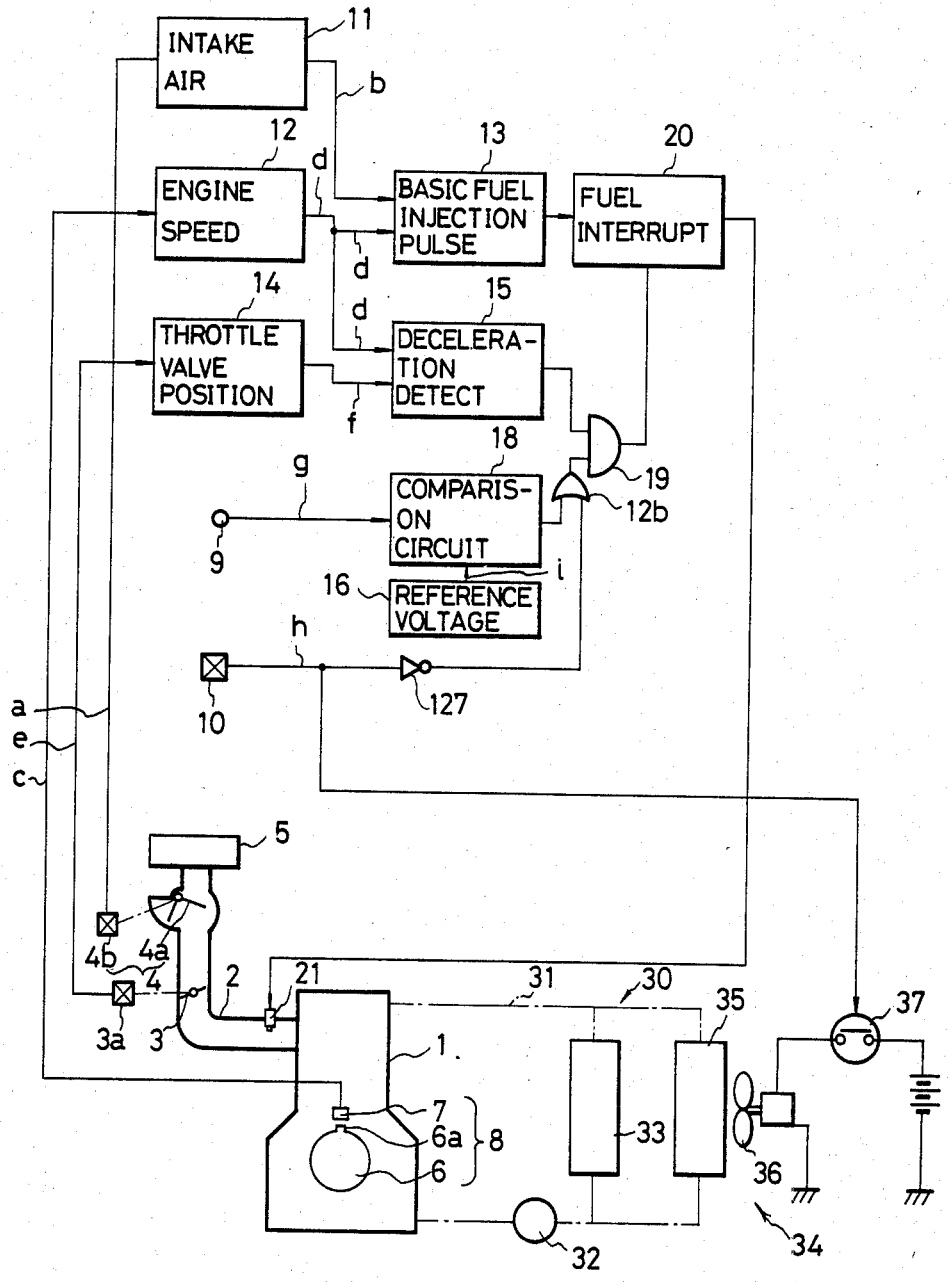
FIG. 4 is a view similar to FIG. 1 but showing a further embodiment of the present invention.
Figure 5:
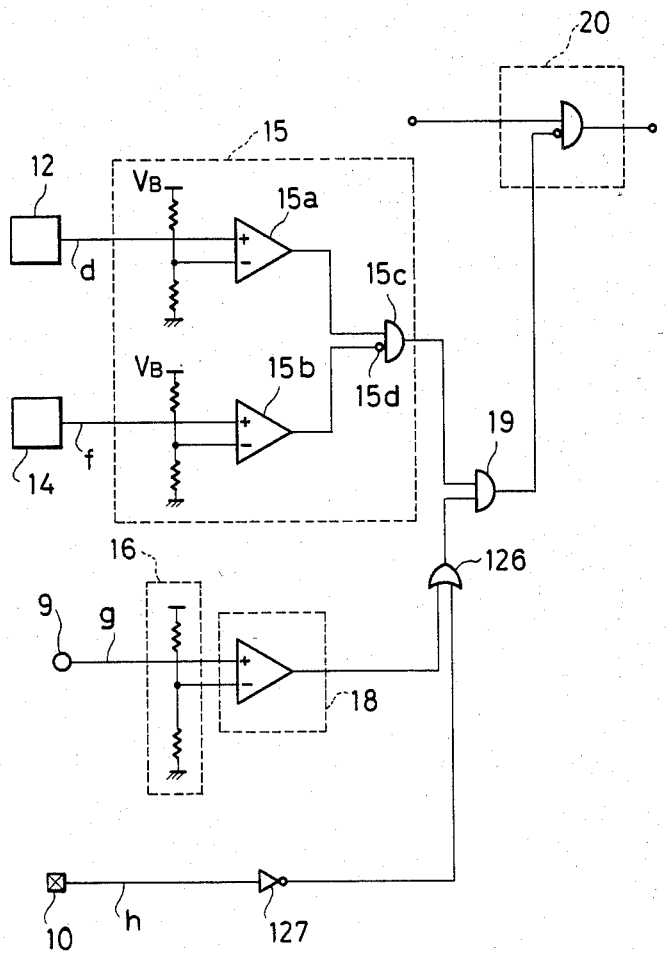
FIG. 5 is a diagram showing details of the circuit in the fuel supply control system in the embodiment shown in FIG. 4; and, FIG. 6 shows a modificatin of the circuit shown in FIG. 5.

FIGS. 4 and 5 show a further embodiment of the present invention which is basically the same as the embodiment shown in FIGS. 1 and 2 so that corresponding parts are shown by the same reference numerals as in FIGS. 1 and 2. In this embodiment, the comparator 18 is arranged only to compare the engine temperature signal g with the reference voltage i from the reference circuit 16 and the output from the comparator 18 is applied to an OR gate 126. The heater switch 10 is connected through an inverter 127 with the OR gate 126. In this embodiment, the fuel supply interrupting circuit 20 is operated in deceleration unless the engine temperature is below a predetermined value and the vehicle heater is in operation.

Figure 6:
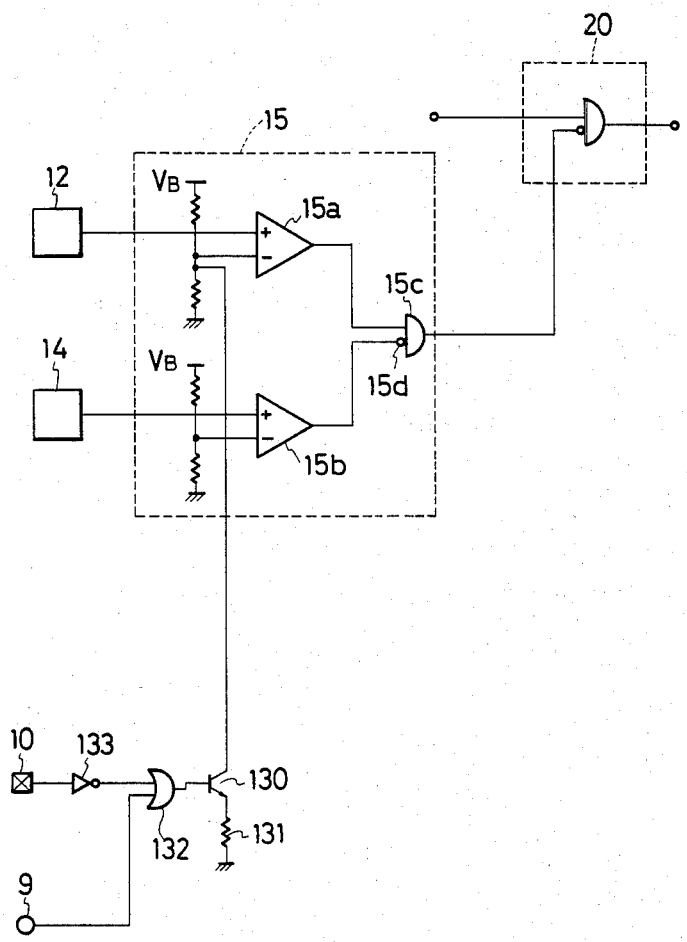

FIG. 6 shows a further modification of the circuit for controlling the fuel supply. In this arrangement, the voltage divider associated with the comparator 15*a* in the deceleration detecting circuit 15 is connected with a switching transistor 130 which is grounded through a resistor 131. Since the resistor 131 is in parallel with the grounding resistor in the voltage divider, the reference voltage applied to the comparator 15*a* is decreased when the transistor 130 is turned on. The base of the transistor 130 is connected with the output of an OR gate 132 which has inputs one being connected with the engine temperature sensor 9 and the other with the heater switch 10 through an inverter 133. It will therefore be understood that the transistor 130 is turned off only when the engine temperature is below a predetermined value and the vehicle heater is in operation to thereby increase the reference voltage applied to the comparator 15*a*. Thus, in this embodiment, the fuel supply is interrupted when the engine speed is greater than a first predetermined value with the throttle valve 3 closed if the vehicle heater is not in operation. However, if the vehicle heater is in operation, the fuel supply is cut only when the engine speed is above a second predetermined value which is larger than the first predetermined value.

The invention has thus been shown and described with reference to specific embodiments, however, it should be noted that the invention is in no way limited to the details of the illustrated arrangements but changes and modifications may be made without departing from the scope of the appended claims. For example, the fuel supply control circuit may be substituted by a microprocessor with an appropriate program to accomplish the same functions.

We claim:

1. A motor vehicle including an internal combustion engine having a fuel supply system for providing a supply of fuel, deceleration detecting means for detecting that the engine is in deceleration, heating means having heat exchanging means for bringing air in the vehicle into a heat exchange relationship with an engine cooling medium so that said air in the vehicle is heated by the engine cooling medium, heater operation detecting means for detecting that the heating means is in operation, fuel supply control means responsive to outputs of said deceleration detecting means and said heater operation detecting means for interrupting the supply of fuel when the engine is in deceleration and the heating means is not in operation.

2. A motor vehicle in accordance with claim 1 in which the engine is further provided with engine temperature detecting means for producing an engine temperature signal which is applied to the fuel supply control means, said fuel supply control means including means for interrupting the supply of fuel when the engine is in deceleration and the heating means is not in operation and the engine temperature is above a predetermined value.

3. A motor vehicle including an internal combustion engine having a fuel supply system for providing a supply of fuel, engine temperature detecting means, deceleration detecting means for detecting that the engine is in deceleration, heating means having heat exchanging means for bringing air in the vehicle into a heat exchange relationship with an engine cooling medium so that said air in the vehicle is heated by the engine cooling medium, heater operation detecting means for detecting that the heating means is in operation, fuel supply control means responsive to outputs of said engine temperature detecting means, said deceleration detecting means and said heater operation detecting means for interrupting the supply of fuel when the engine is in deceleration, the heating means is in operation and the engine temperature is above a first predetermined value, annd also when the engine is in deceleration, the heating means is not in operation and the engine temperature is above a second predetermined value which is lower than the first predetermined value.

4. A motor vehicle in accordance with claim 3 in which said fuel supply control means includes comparing means for comparing the output from the engine temperature detecting means with a reference signal so as to interrupt the fuel supply when the engine temperature is above the second predetermined value in deceleration with the heating means not in operation.

5. A motor vehicle including an internal combustion engine having a fuel supply system for providing a supply of fuel, engine temperature detecting means, engine speed detecting means, deceleration detecting means for detecting that the engine is in deceleration, heating means having heat exchanging means for bringing air in the vheicle into a heat exchange relationship with an engine cooling medium so that said air in the vehicle is heated by the engine cooling medium, heater operation detecting means for detecting that the heating means is in operation, fuel supply control means responsive to outputs of said engine temperature detecting means, said engine speed detecting means, said deceleration detecting means and said heater operation detecting means for interrupting the supply of fuel when the engine is in deceleration and the engine speed is greater than a first predetermined value, and also when the engine is in deceleration and the engine speed is greater than a second predetermined value which is larger than the first predetermined value and the heater means is in operation with the engine temperature below a predetermined value.

* * * * *